US011136825B2

(12) United States Patent
Yousef et al.

(10) Patent No.: US 11,136,825 B2
(45) Date of Patent: Oct. 5, 2021

(54) TOP DRIVE

(71) Applicant: Nabors Drilling Technologies USA, Inc., Houston, TX (US)

(72) Inventors: Faisal Yousef, Houston, TX (US); Randy Pyrch, Montgomery, TX (US); William R. Slocum, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 14 days.

(21) Appl. No.: 16/669,295

(22) Filed: Oct. 30, 2019

(65) Prior Publication Data

US 2020/0131851 A1 Apr. 30, 2020

Related U.S. Application Data

(60) Provisional application No. 62/753,750, filed on Oct. 31, 2018.

(51) Int. Cl.
*E21B 3/02* (2006.01)

(52) U.S. Cl.
CPC ..... *E21B 3/02* (2013.01)

(58) Field of Classification Search
CPC ..... E21B 3/022
See application file for complete search history.

(56) References Cited

U.S. PATENT DOCUMENTS 1,737,793 A * 12/1929 Harris ..... E21B 21/02 285/61
2,998,084 A * 8/1961 Johnson ..... E21B 19/16 175/85
7,401,664 B2 7/2008 Wells et al.
7,748,445 B2 * 7/2010 Wells ..... E21B 19/16 166/77.1
2005/0274508 A1 * 12/2005 Folk ..... E21B 19/02 166/77.52
2006/0096751 A1 5/2006 Brown et al.
2007/0140801 A1 6/2007 Kuttel et al.
2014/0116781 A1 * 5/2014 Kuttel ..... E21B 17/03 175/57
2017/0159360 A1 * 6/2017 Netecke ..... H02K 7/14
2019/0048939 A1 * 2/2019 Aas ..... E21B 3/04

FOREIGN PATENT DOCUMENTS

CN 103592068 B 2/2014
CN 203385500 U 4/2014
CN 104502006 B 4/2015
KR 20120129091 A1 11/2012
KR 101440180 B1 9/2014

* cited by examiner

*Primary Examiner* — Cathleen R Hutchins
*Assistant Examiner* — Ronald R Runyan
(74) *Attorney, Agent, or Firm* — Abel Schillinger, LLP; Enrique Abarca

(57) ABSTRACT

A top drive comprising: a housing; a bearing coupled to the housing, the bearing defining an upper surface; and a quill coupled to the bearing, wherein an engagement interface between the quill and bearing is disposed along the upper surface of the bearing. A method of installing a quill in a top drive comprising: providing a top drive preassembly comprising a housing, a bonnet coupled with the housing, and a spindle coupled with the housing; translating the quill in a direction toward the top drive preassembly through an opening in the bonnet; and after aligning the quill relative to the top drive preassembly, securing the quill to the top drive preassembly with a securing element.

20 Claims, 2 Drawing Sheets

TOP DRIVE

CROSS-REFERENCE TO RELATED APPLICATIONS

This application claims priority under 35 U.S.C. § 119(e) to U.S. Provisional Application No. 62/753,750, entitled "TOP DRIVE," by Faisal Yousef et al., filed Oct. 31, 2018, which is assigned to the current assignee hereof and is incorporated herein by reference in its entirety.

FIELD OF THE DISCLOSURE

The present disclosure relates to subterranean drilling, and more particularly to top drives used in subterranean drilling operations.

RELATED ART

Top drives typically include powered rotating drive units adapted to rotatably bias a drill string to advance a bottom hole assembly, coupled with a lower end of the drill string, into a subterranean formation. The top drive can be coupled with a drill string, for example through a quill or other intermediary element. The quill can be adapted to transfer forces provided by the top drive to the drill string.

During drilling operations, the drill string is advanced into the wellbore by rotatably biasing the drill string and bottom hole assembly. As the drill string advances into the subterranean formation, surface connection between the top drive and drill string can require addition of pipe segments or pipe stands to the drill string.

It is sometimes necessary to remove the quill from the top drive. For instance, the quill may need to be replaced, repaired, or inspected.

Traditional top drive assemblies require significant operations and time to replace quills. The drilling industry continues to demand improvements in top drives, and top drive-quill engagement protocol in particular.

BRIEF DESCRIPTION OF THE DRAWINGS

Embodiments are illustrated by way of example and are not limited in the accompanying figures.

DETAILED DESCRIPTION

Figure 1:
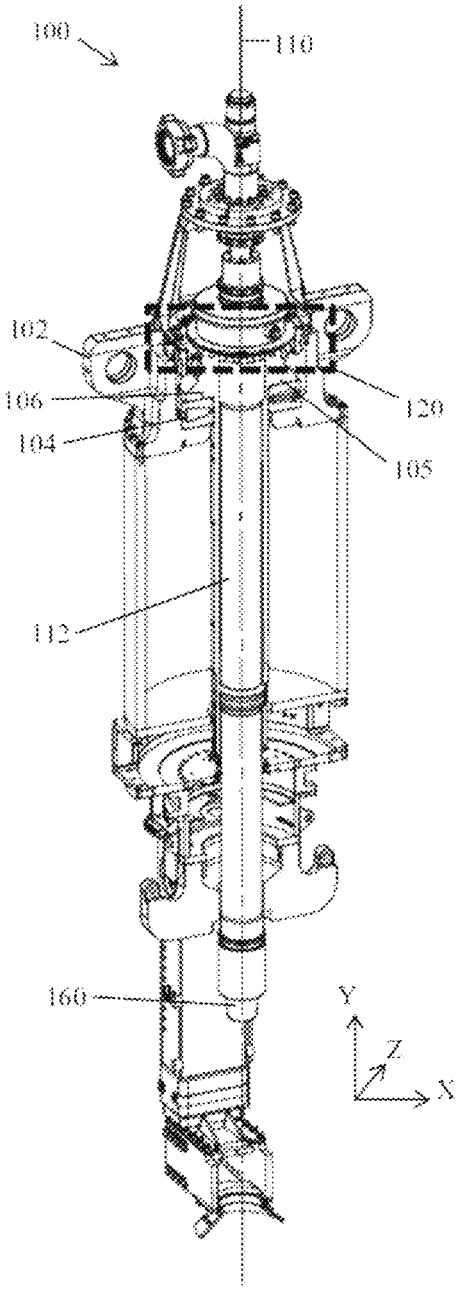
FIG. 1 includes a cross-sectional isometric view of a system including a top drive in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

As used herein, "generally equal," "generally same," and the like refer to deviations of no greater than 10%, or no greater than 8%, or no greater than 6%, or no greater than 4%, or no greater than 2% of a chosen value. For more than two values, the deviation can be measured with respect to a central value. For example, "generally equal" refer to two or more conditions that are no greater than 10% different in value. Demonstratively, angles offset from one another by 98% are generally perpendicular.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

A top drive in accordance with one or more embodiments described herein can generally include a housing, a bearing coupled to the housing, and a quill coupled with, or adapted to couple with, the bearing. In an embodiment, the quill can be directly coupled with the bearing. In another embodiment, the quill can be coupled to the bearing through one or more intermediary elements, such as a spindle. The housing can be part of a housing of the top drive, such as an outer portion or body of the top drive. In a particular embodiment, the bearing can define an upper surface and a lower surface as defined during drilling operations. An engagement interface between the quill and bearing can be disposed along the upper surface of the bearing. In a particular embodiment, the engagement interface between the quill and bearing can be spaced apart by an intermediary element, such as a spindle. In certain instances, the upper surface of the bearing can engage with the spindle. The spindle can be disposed between the upper surface of the bearing and the quill, or a portion of the quill engageable with the spindle or bearing.

In an embodiment, the quill can be removed from the top drive without removing the housing or any portion thereof from the top drive. In another embodiment, the quill can be configured to move from a first axial position with respect to the housing to a second axial position with respect to the housing while the bearing remains fixedly coupled to the housing.

In certain instances, the quill can be installed or removed from the top drive without requiring significant modification or operation of the top drive. For example, in an embodiment, a top drive preassembly can include a housing and a bearing coupled to the housing. A quill can be translated relative to the top drive preassembly, such as toward (installation) or away from (removal) the top drive preassembly. The quill can be aligned relative to the top drive preassembly and secured or unsecured therefrom by way of a securing element, such as a threaded fastener.

FIG. 1 includes a top drive 100 including a housing 102 and a bearing 104 coupled to the housing 102. The housing 102 can include a portion of the top drive 100 that extends around components of the top drive 100, such as pumps, motors, gears, seals, and other internal components thereof. In a particular instance, the housing 102 can be ruggedized, such as formed from a hardened material, to prevent damage to the components of the top drive 102. In a particular embodiment, the housing 102 can include metal or alloy. In certain embodiments, the housing 102 can include a single, monolithic structure defining an internal volume adapted to contain at least a portion of the components of the top drive 102. In other embodiments, the housing 102 can include a plurality of housing elements that can be coupled together. For example, in a particular embodiment, the housing 102 can include at least two housing elements secured together to define an internal volume adapted to contain at least a portion of the components of the top drive 102. In yet more particular embodiments, the housing 102 can include at least three housing elements secured together, at least four housing elements secured together, at least five housing elements secured together, or at least ten housing elements secured together. In certain instances, the housing elements can be coupled together by one or more fasteners, such as one or more threaded fasteners, clips, bayonet connections, other non-threaded fasteners, or any combination thereof.

The top drive 100 can include a spindle 105 disposed at least partially within the housing 102. The spindle 105 can be coupled with the bearing 104. The spindle 105 can be disposed between the bearing 104 and a portion of the quill 112. The spindle 105 can be disposed along a top portion of the housing 102. A top surface 108 (FIG. 3) of the spindle 105 can be at least partially visible from an external environment. The top surface 108 can be at least partially viewed through one or more cutouts 136 in a side of the frustoconically shaped bonnet 130. The one or more cutouts 136 can allow operators to access the fasteners (or securing elements) 124 that can be used to removably attach the hub 170 to the flange 114 and removably attach the flange 114 to the spindle 105. Therefore, an operator can remove the securing elements 124 via the access through the one or more cutouts 136 and then remove the flange 114 and quill 112 from the top drive 100 through the opening 138 in the top of the bonnet 130. The top surface 108 of the spindle 105 can be visible from the external environment (i.e. through the one or more cutouts 136) when a quill 112 (described in greater detail below) is not present in the top drive 100. The spindle 105 can be at least partially visible from the external environment when the top drive 102 is being used in drilling operations, such as for example, when actively drilling into a wellbore.

The quill 112 can be coupled directly with the bearing 104, such as coupled directly with a top surface 106 of the bearing 104.

The bearing 104 or spindle 105 can be rotatably coupled relative to the housing 102. The bearing 104 or spindle 105 can be rotatable with respect to the housing 102. The bearing 104 or spindle 105 can be rotatably biased by a motor, actuator, other drive mechanism of the top drive 100, or any combination thereof. The bearing 104 or spindle 105 can be directly biased by the motor, actuator, or other drive mechanism. For example, the bearing 104 or spindle 105 can include keys, gears, teeth, or other synchronization elements adapted to transfer torque from the motor, actuator, or other drive mechanism to the quill 112. The bearing 104 or spindle 105 can be indirectly biased by the motor, actuator, or other drive mechanism through an intermediary element (not illustrated).

The bearing 104 or spindle 105 can be rotatable about an axis 110 extending at least partially through the housing 102 of the top drive 100. The axis 110 can correspond, or generally correspond, with a Y-axis of an X-, Y-, Z-field. The axis 110 can correspond, or generally correspond, with a vertical axis as oriented during drilling operations (e.g., when the top drive 100 is in use on a drilling rig). The axis 110 can correspond with, or generally correspond with, a length of the quill 112 to be used with the top drive 100. The bearing 104 or spindle 105 can be adapted to rotate about a plane defined, or generally defined, in an X-, Z-plane.

The quill 112 can include an elongated structure having a length adapted to rotate about, or generally about, the axis 110. The quill 112 can have a generally cylindrical shape. The quill 112 can have a generally uniform diameter, as measured along at least a portion of the length of the quill 112. The quill 112 can have a generally uniform diameter as measured along a majority of the length of the quill 112.

The quill 112 can include a pipe engagement interface 160 adapted to engage with a pipe segment or one or more intermediary elements, such as a sub, adapted to be disposed between the quill 112 and the drill string (not illustrated). The pipe engagement interface 160 can include, for example, a threaded element adapted to engage with threads of a pipe segment. The pipe engagement interface 160 can be reinforced or hardened to prevent premature wear or damage during drilling or coupling with pipe segments. The pipe engagement interface 160 of the quill 112 can be disposed on or adjacent to a longitudinal end of the quill 112 opposite the longitudinal end of the quill 112 adapted to contact the bearing 104.

Figure 2:
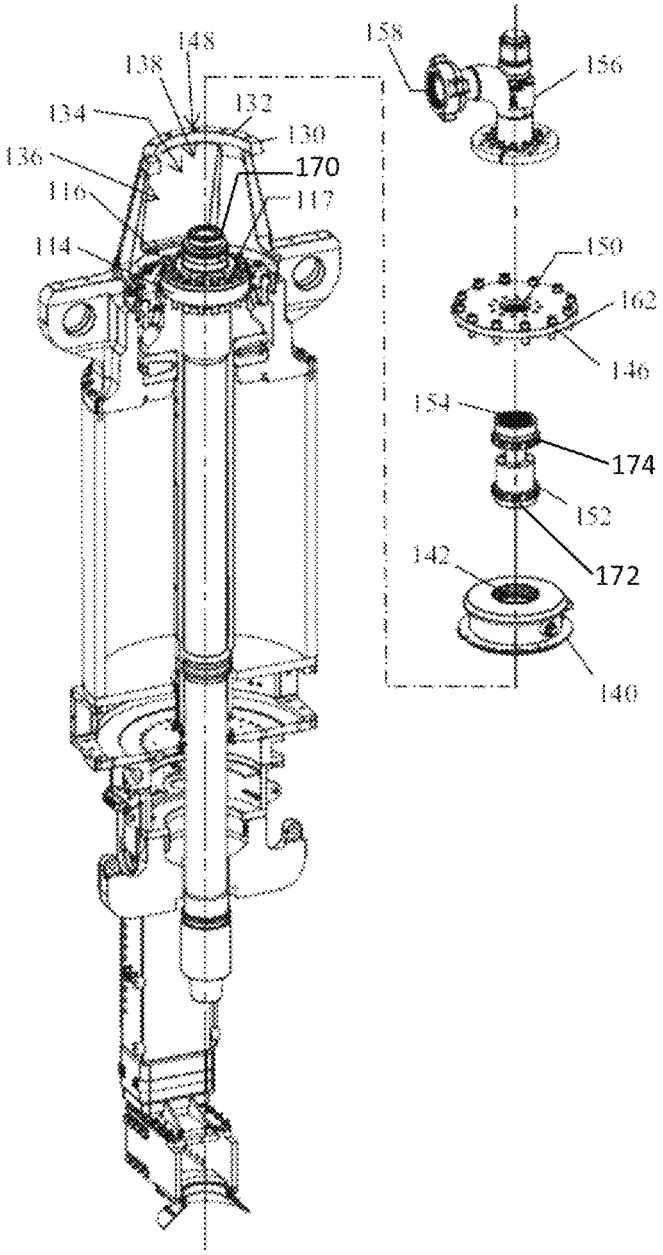
FIG. 2 includes a partially exploded cross-sectional isometric view of a top drive in accordance with an embodiment.

Referring to FIG. 2, the quill 112 can include a flange 114. The flange 114 can be spaced apart from a central area of the quill 112. The flange 114 can be disposed adjacent to a longitudinal end 116 of the quill 112. The flange 114 can be disposed at the longitudinal end 116. The flange 114 can define the longitudinal end 116 of the quill 112. In certain instances, for example, a surface 117 of the flange 114 can define the longitudinal end 116 of the quill 112.

The flange 114 can include a hub 170 extending from the quill 112 a distance, $D_H$. The distance $D_H$ can be at least 0.01 m, at least 0.05 m, at least 0.1 m, at least 0.2 m, or at least 0.3 m. In another particular embodiment, $D_H$ can be no greater than 3 m, no greater than 2 m, no greater than 1 m, or no greater than 0.5 m. In an embodiment, the flange 114 can be continuous as measured around a circumference of the quill 112. That is, for example, the flange 114 can be defined by a continuous body around the entire circumference of the quill 112. The flange 114 can have an outer surface 118 spaced apart from a center of the flange 114 equidistantly around the entire circumference of the quill 112. The flange 114 can include one or more notches, grooves, lobes, openings, cavities, or any combination thereof.

The flange 114 can define a thickness, $T_F$, as measured in a direction generally parallel with a length of the quill 112. The thickness, $T_F$, of the flange 114 can be generally uniform as measured around a circumference of the quill 112. The thickness, $T_F$, of the flange 114 can be uniform as measured around a circumference of the quill 112.

The quill 112 can be free, or essentially free, of a flange. In such a manner, the quill 112 can define a generally cylindrical body with a diameter deviation less than 20%, less than 15%, less than 10%, or less than 5% as measured along a length of the quill 112.

The quill 112 can include a torque transfer element adapted to transfer torque from the spindle 105 (or directly from the bearing 104) to the quill 112. The torque transfer element can include gears, teeth, splines, cutouts, grooves, other complementary engagement features, or any combination thereof. The torque transfer element can be adapted to couple with the bearing 104 or spindle 105 and transfer torque from the drive unit to the quill 112. The torque transfer element can be adapted to receive an input torque from the bearing 104 or spindle 105 and produce an output torque at the drill string (not illustrated) coupled with the quill 112. The torque transfer element can be adapted to translate relative to the bearing 104 or spindle 105. More particularly, the torque transfer element can be shaped and sized to permit longitudinal removal of the quill 112 from the bearing 104 or spindle 105 upon application of a translational force applied on the quill 112, the bearing 104, the spindle 105, or a combination thereof in a direction generally parallel with the axis 110 of the top drive 100.

Referring again to FIG. 1, the quill 112 and bearing 104 or quill 112 and spindle 105 can be adapted to be coupled together at an engagement interface 120. The engagement interface 120 can be defined by the flange 114 of the quill 112 and the bearing 104 or spindle 105. The engagement interface 120 can be defined by a lower surface 122 of the flange 114 and a top surface of the bearing 104 or the top surface 108 of the spindle 105. The lower surface 122 of the flange 114 (FIG. 4) and top surface of the bearing 104 (FIG. 3) or top surface of the spindle 105 can be spaced apart from one another by one or more intermediary elements, such as films, dampeners, stanchions, or the like.

Figure 3:
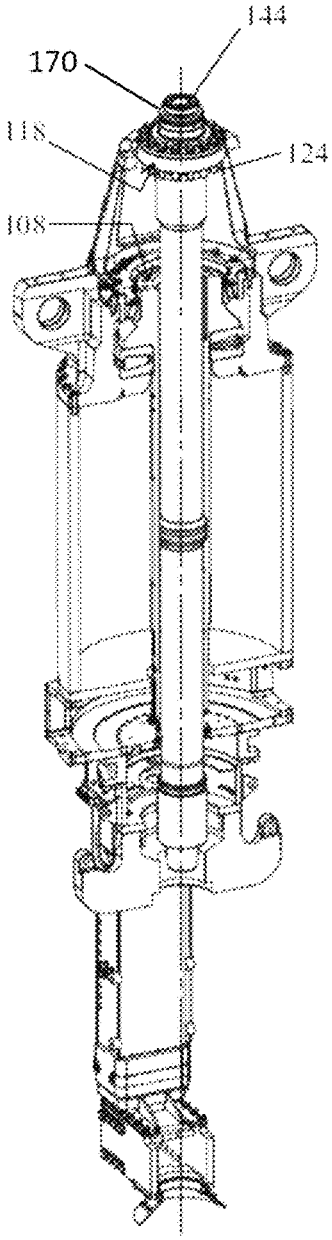
FIG. 3 includes a partially exploded cross-sectional isometric view of a top drive in accordance with an embodiment.

As illustrated in FIG. 3, at least one securing element 124 can be adapted to connect the quill 112 and bearing 104 or quill 112 and spindle 105 together at the engagement interface 120. The at least one securing element 124 can include at least one securing element, at least two securing elements, at least five securing elements, at least ten securing elements, or at least twenty securing elements. In another embodiment, the at least one securing element 124 can include no greater than 500 securing elements, no greater than 200 securing elements, no greater than 100 securing elements, or no greater than 50 securing elements. The at least one securing element 124 can include a threaded fastener or a non-threaded fastener.

A plurality of securing elements 124 can extend through openings 126 (FIG. 4) in the flange 114 of the quill 112. At least one of the securing elements 124 can couple with the bearing 104 or spindle 105. In a particular embodiment, the at least one of the bearing 104 or spindle 105 can include one or more openings 128 adapted to receive the at least one securing element 124. The one or more openings 128 can be threaded and adapted to engage with threads on the at least one securing element 124.

The openings 126 and 128 can be synchronized such that when aligned, all openings 126 align with a corresponding opening 128. In another embodiment, at least one of the openings 126 can be desynchronized or at least one opening 128 can be desynchronized such that it does not align with a corresponding opening 126 or 128.

The openings 126 are equally spaced apart around the flange 114. For instance, the openings 126 can be equidistantly spaced apart from one another. In a further embodiment, the openings 126 can be equidistantly spaced apart from a center of the quill 112. In an embodiment, the openings 126 can be reflectively symmetrical about a line intersecting a center of the quill 112. In another embodiment, the openings 126 can be rotationally symmetrical. In yet a further embodiment, the openings 126 can be non-reflectively symmetrical, non-rotationally symmetrical, or a combination thereof.

The at least one securing element 124 is visible from the external environment. The at least one securing element 124 can be accessible to an operator without removing the housing 102, or any portion thereof. Thus, for example, an operator, such as a drilling rig deck hand, can access the at least one securing element 124. The at least one securing element 124 can be removable from the engagement interface 120 without removing the housing 102 or any portion thereof. In such a manner, the at least one securing element 124 can be removed from the top drive 100 to permit detachment of the quill 112 from the bearing 104.

The at least one securing element 124 can be removable from the housing 102 in a first direction. For example, the at least one securing element 124 can be removed from the housing by translating the at least one securing element 124 in the first direction. It is noted for certain fasteners, removal of the at least one securing element 124 can further require rotation of the at least one securing element 124. The quill 112 can be removable from the housing 102 in the first direction, or in a direction generally corresponding with the first direction. The quill 112 and the at least one securing element 124 can be removed from the top drive 100 in a same, or generally same, direction as compared to one another.

A bonnet 130 can be coupled with the top drive 100. The bonnet 130 can be directly or indirectly coupled with the housing 102. The bonnet 130 can be coupled to the housing 102 by one or more threaded or non-threaded fasteners. The one or more threaded or non-threaded fasteners can be visible or accessible to an operator.

Referring to FIG. 2, the bonnet 130 can include a body 132 defining a central region 134. The central region 134 of the bonnet 130 can define an opening extending between opposite sides of the bonnet 130. In a more particular embodiment, the body 132 can define a generally cuboidal or semi-cuboidal shape. In another more particular embodiment, the body 132 can define a generally frustoconical shape. In a particular instance, the bonnet 130 can taper from a first diameter, $D_1$, to a second diameter, $D_2$, where $D_2$ is less than $D_1$. The first diameter $D_1$ can be disposed closer to the housing 102 of the top drive as compared to the second diameter $D_2$. The opening of the central region 134 can extend between the first and second diameters of the bonnet 130.

The one or more cutouts (or openings) 136 can extend through the body 132 connecting the central region 134 to the external environment. The one or more cutouts 136 can be disposed at least partially on side surfaces of the bonnet 130. The one or more cutouts 136 can have a same, or generally same, shape as compared to one another. The at least two of the one or more cutouts 136 can have different shapes as compared to one another. The at least one of the cutouts 136 can be sized to permit operator access to the at least one securing element 124 through the cutout 136. The bonnet 130 can include at least two cutouts 136, at least three cutouts 136, at least four cutouts 136, or at least five cutouts 136. In another embodiment, the bonnet 130 can include no greater than 20 cutouts, no greater than 10 cutouts, or no greater than 6 cutouts. The at least a portion of the bearing 104 can be visible through at least one of the one or more cutouts 136.

The bonnet 130 can be coupled to the housing 102 at a location above a top surface 106 of the bearing 104. The bonnet 130 can extend a distance above the top surface 106 of the bearing 104. In another particular instance, the bonnet 130 can be coupled with the housing 102 at a location above the top surface 108 of the spindle 105. The bonnet 130 can extend a distance above the top surface 108 of the spindle 105.

An opening 138 disposed at or near a top area of the bonnet 130 can permit passage of the quill 112 through the bonnet 130 during attachment and detachment operations of the quill 112. The quill 112 can pass through the opening 138 of the bonnet 130 while the bonnet 130 remains attached to the housing 102.

The opening 138 can define a generally arcuate shape, such as a circular shape. In other instances, the opening 138 can define a polygonal shape, such as a triangular shape, a quadrilateral shape, a pentagonal shape, a hexagonal shape, a heptagonal shape, an octagonal shape, a nonagonal shape, a decagonal shape, a hendecagonal shape, a dodecagonal shape, or another polygonal shape. The opening 138 can be rotationally symmetrical, reflectively symmetrical, or both.

The opening 138 can define a diameter, $D_{OB}$, greater than a diameter, $D_F$, of the flange 114 of the quill 112. The $D_{OB}$ can be at least 1.001 $D_F$, at least 1.01 $D_F$, at least 1.05 $D_F$, at least 1.1 $D_F$, or at least 1.25 $D_F$. The $D_{OB}$ can be no greater than 10 $D_F$, no greater than 5 $D_F$, or no greater than 2 $D_F$. The $D_{OB}$ can be at least 0.1 inches greater than $D_F$, at least 0.5 inches greater than $D_F$, or at least 1 inch greater than $D_F$. The $D_{OB}$ can be at least 1.5 inches greater than $D_F$, at least 2 inches greater than $D_F$, at least 3 inches greater than $D_F$, or at least 4 inches greater than $D_F$. The $D_{OB}$ can be no greater than 120 inches greater than $D_F$, no greater than 60 inches greater than $D_F$, no greater than 24 inches greater than $D_F$, or no greater than 12 inches greater than $D_F$.

The quill 112 can be adapted to be removed from the top drive 100 while the bonnet 130 remains attached with the housing 102 of the top drive 100. The quill 112 can be adapted to be removed from the top drive 100 through the opening 138 in the bonnet 130 while the bonnet 130 remains attached with the housing 102 of the top drive 100. In such a manner, an operator may remove the quill 112 without requiring removal of the bonnet 130 which can require several hours to complete.

The bonnet 130 can include a cap 146 defining a lumen 150 adapted to be in fluid communication with a lumen 144 of the quill 112 or permit fluid communication with the lumen 144 of the quill 112 to components coupled with the cap 146.

The cap 146 can be removably engaged with the bonnet 130. The cap 146 can be coupled to the body 132 of the bonnet 130 by a plurality of fasteners 162. The at least one of the plurality of fasteners 162 can be engaged with an upper surface 148 of the bonnet 130. All of the plurality of fasteners 162 can be engaged with the upper surface 148 of the bonnet 130. The fasteners 162 can include threaded fasteners, non-threaded fasteners, clips, ties, bayonet connections, locks, another engagement interface, or any combination thereof. Removal of the cap 146 from the body 132 of the bonnet 130 can permit passage of the quill 112 through the opening 134. The cap 146 is removed from the bonnet 130 prior to removing the quill 112 from the top drive 100.

In the illustrated embodiment, the cap 146 is adapted to lie along a plane generally corresponding with the X-Z plane during drilling operations. The cap 146 can be removed by translating the cap 146 in a direction away from the top drive 100. The cap 146 can be removed by at least partially rotating the cap 146 with respect to the X-Z plane. The cap 146 can be pivotally coupled with the body 132 of the bonnet 130 to permit rotatable access to the opening 138.

A seal carrier 140 can be disposed between the cap 146 and the quill 112, such as between the cap 146 and flange 114. The seal carrier 140 can prevent undesired contamination within the top drive 100, such as within the housing 102. Contamination can affect drilling efficiency and cause premature wear or failure of the top drive 100. The seal carrier 140 can be coupled to the flange 114 via one or more threaded or non-threaded fasteners. The one or more threaded or non-threaded fasteners can be visible when the top drive 100 is in operation. The one or more threaded or non-threaded fasteners can be accessible when the top drive 100 is in operation.

A wash pipe 152 can be disposed between the seal carrier 140 and cap 146. The wash pipe 152 can include a lumen 154 in fluid communication with the lumen 150 of the cap 146, the lumen 144 of the hub 170, a lumen of the quill 112, or any combination thereof. The lumen 154 of the wash pipe 152 can be in fluid communication with the lumen of the quill 112 and the lumens 144, and 150. The wash pipe 152 can include a top nut 174 and a bottom nut 172. The bottom nut 172 can be threaded onto the hub 170 when a top portion of the hub 170 protrudes above the seal carrier 140. The top nut 174 can be threaded onto a bottom portion of the cap 146. The quill 112 can be translated into the top drive assembly 100 by installing the quill 112 through the opening 138 into the top drive preassembly 500 until the flange 114 engages the spindle 105. The hub 170 can then be attached to the flange 114 by one or more securing elements 124, which also can extend into the spindle 105 to secure the hub 170 to the flange and also to the spindle 105. The seal carrier 140 can then be installed over the hub 170 with a portion of the hub 170 extending through the lumen 142 of the seal carrier 140. The wash pipe 152 can be attached to the portion of the hub 170 that extends through the seal carrier 140, via the bottom nut 172. The bottom nut 172 can be an integral part of a lower portion of the 152 that is rotationally coupled to an upper portion of the wash pipe 152 with the upper portion telescopingly extending into the lower portion of the wash pipe 152. The top nut 174 can be an integral part of the upper portion of the wash pipe 152. The top nut 174 can be coupled to the cap 146, with a gooseneck 156 removably attached to the cap 146. The resulting assembly provides a fluid path through the gooseneck 156, the hub 170, the flange 114, and the quill 112, allowing fluid to pass through the top drive 100 into a tubular connected to the bottom end of the quill 112.

A gooseneck 156 or other similar connection can be disposed above the cap 146. The gooseneck 156 can define a lumen 158 extending therethrough. The lumen 158 of the gooseneck can be in fluid communication with the lumen of the quill 112, the lumen 144 of the hub 170, the lumen 154 of the wash pipe 152, the lumen 150 of the cap 146, or any combination thereof. The lumen 158 of the gooseneck 156 is in direct fluid communication with the lumen 150 in the cap 146. The lumen 158 of the gooseneck 156 lies along a non-straight line, such as a line having an approximately 90-degree bend.

The gooseneck 156 can be coupled with one or more fluid lines or intermediary elements (not illustrated) in communication with an agitating device (not illustrated), such as a shaker or mud-gas-separator.

Removal of the quill 112 from the top drive 100 can be performed without requiring removal of the bonnet 130 or housing 102 of the top drive 100. FIG. 1 includes a cross-sectional view of the top drive 100 with the gooseneck 156, cap 146, wash pipe 152, seal carrier 140, and quill 112 disposed in their in-use configuration (i.e., as used during drilling operations). In the illustrated embodiment, the quill 112 is disposed below the seal carrier 140, which is disposed below the wash pipe 152, which is disposed below the cap 146, which is disposed below the gooseneck 156. Rotational biasing of the spindle 105 can rotate the quill 112 about the axis 110.

Referring to FIG. 2, removal of the quill 112 can occur after removing the gooseneck 156, wash pipe 152, and seal carrier 140. The cap 146 can be removed from the bonnet 130 to clear the opening 138 and permit a path of travel for the quill 112 from the top drive 100. The flange 114 of the quill 112 is accessible after removal of the gooseneck 156, wash pipe 152, cap 146, and seal carrier 140. Fasteners 124 can be removed, permitting longitudinal translation of the quill 112 relative to the spindle 105. In certain instances, removal of the fasteners 124 can be performed by reaching through one or more of the cutouts 136 in the body 132 of the bonnet 130. In other instances, removal of the fasteners 124 can be performed by reaching through the opening 138 of the body 132. The removal of the fasteners 124 can occur by reaching through both the opening 138 and one or more of the cutouts 136.

Figure 4:
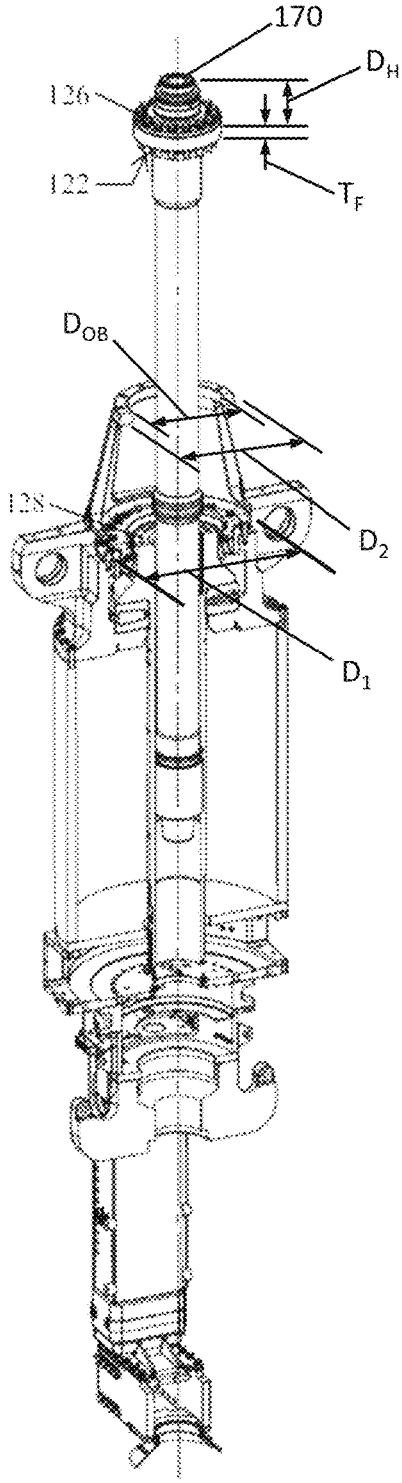
FIG. 4 includes a partially exploded cross-sectional isometric view of a top drive in accordance with an embodiment.

With the gooseneck 156, wash pipe 152, cap 146, and seal carrier 140 detached, the quill 112 can be translated in a direction away from the housing 102 through the opening 138 in the bonnet 130. FIG. 3 includes a cross-sectional view of the top drive 100 as the flange 114 of the quill 112 passes through the opening 138. FIG. 4 illustrates the quill 112 after the flange 114 has passed through the opening 138 in the bonnet 130.

Removal of the quill 112 can be performed manually. In other instances, removal of the quill 112 can be performed by a machine, such as a machine on a drill rig floor, a stand-alone machine used for quill removal, or a combination thereof. Force used to remove the quill 112 from the top drive 100 can be provided in a direction parallel, or generally parallel, with the axis 110 of the quill 112. As the quill 112 translates from the top drive 100, the quill 112 can pass through the bearing 104, the spindle 105, and bonnet 130. In certain instances, at least one of the bearing 104 and spindle 105 can remain in the housing 102 during removal of the quill 112. The bonnet 130 can remain attached to the housing 102 during removal of the quill 112.

Figure 5:
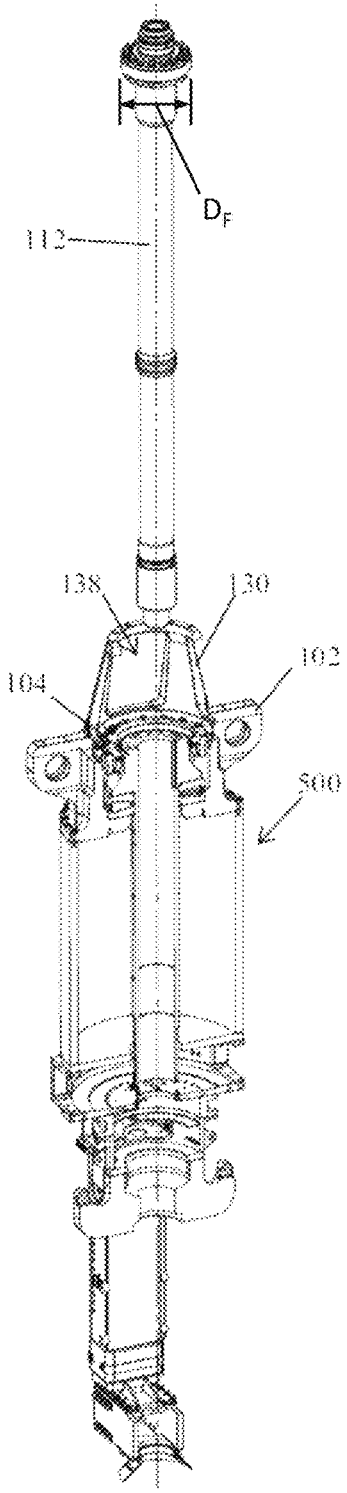
FIG. 5 includes a partially exploded cross-sectional isometric view of a top drive in accordance with an embodiment.

FIG. 5 includes a view of a top drive preassembly 500 with the quill 112 removed from the housing 102. The top drive preassembly 500 can include the housing 102, the bearing 104, the spindle 105, or a combination thereof. The bearing 104 can be pre-installed with the housing 102. The bearing 104 can be pre-installed such that the bearing 104 is retained at a generally fixed position during installation and removal of the quill 112. The spindle 105 can be pre-installed with the housing 102. The spindle 105 can be pre-installed such that the spindle is retained at a generally fixed position during installation and removal of the quill 112. As used with respect to the bearing 104 or spindle 105 in the top drive preassembly 500, a "generally fixed position" is intended to refer to a position whereby the bearing 104 or spindle 105 can rotate. Further, "generally fixed position" can refer to a position whereby the bearing 104 or spindle 105 is not permitted, or generally not permitted, to translate relative to the housing 102. In certain instances, the quill 112 can be introduced to the top drive preassembly 500 through the opening 138 in the bonnet 130. Installation of the quill 112 can occur by translating the quill 112 in a direction toward the top drive preassembly 500. In a more particular embodiment, the flange 116 of the quill 112 can be translated toward the bearing 104 or spindle 105. In certain instances, the flange 116 can be translated toward the bearing 104 or spindle 105 until the flange 116 contacts the bearing 104 or spindle 105. In another instance, the flange 116 can be spaced apart from the bearing 104 by one or more films, dampeners, stanchions, or the like. In such instance, the flange 116 can be translated toward the bearing 104 or spindle 105 until contact therebetween is achieved.

After aligning the quill 112 relative to the top drive preassembly 500 (e.g., after the flange 116 contacts the bearing 104 or spindle 105), the securing element 124 can be used to secure the quill 112 to the top drive preassembly 500. In a particular embodiment, securing the quill 112 to the top drive preassembly 500 is performed by securing the quill 112 to the bearing 104 or spindle 105. More particularly, the quill 112 can be secured to the bearing 104 or spindle 105 by the securing elements 124.

In certain instances, securing the quill 112 to the top drive preassembly 500 can be performed by an operator extending a tool or arm through the one or more cutouts 136 in the bonnet 130. The operator can access the engagement interface 120 between the quill 112 and the bearing 104 or spindle 105 and access and secure the securing elements 124 therebetween.

After securing the quill 112, the seal carrier 140, wash pipe 152, cap 146, gooseneck 156, or a combination thereof the drive element of the top drive 100 can be engaged to rotate the quill 112. Rotation of the quill 112 can rotate the drill string (not illustrated), rotatably biasing a drill bit in the wellbore and advancing the drill string into the subterranean formation.

Removal of the quill 112 can occur by removing the seal carrier 140, wash pipe 152, cap 146, gooseneck 156, or a combination thereof from the top drive 100 (FIG. 2). The quill 112 can be disconnected from the bearing 104 or spindle 105 and translated through the opening 138 of the bonnet 130 (FIGS. 3-5). In such a manner, installation and removal of the quill 112 from the top drive 100 can be performed without requiring removal of the housing 102 or any portion thereof. Moreover, the bearing 104 and spindle 105 can remain at a generally fixed position relative to the housing 102. Easy removal of the quill 112 can reduce downtime associated with removal of current quills from top drives, thereby enhancing efficiency and saving operating expenses associated with drilling down time.

Embodiment 1

A top drive comprising:

a housing;

a bearing coupled to the housing, the bearing defining an upper surface; and a quill coupled to the bearing, wherein an engagement interface between the quill and bearing is disposed above the upper surface of the bearing.

Embodiment 2

The top drive of embodiment 1, wherein the quill is rotatably coupled to the housing.

Embodiment 3

The top drive of embodiment 1, further comprising a spindle disposed between the quill and bearing at the engagement interface.

Embodiment 4

The top drive of embodiment 3, wherein the quill is rotatably secured to the bearing by a key.

Embodiment 5

The top drive of embodiment 3, wherein the spindle and quill are removable from top drive in a generally same direction.

Embodiment 6

The top drive of embodiment 3, wherein a wash pipe of the top drive is visible when the top drive is in operation.

Embodiment 7

The top drive of embodiment 3, wherein the quill is coupled with the spindle by at least one securing element, and wherein the at least one securing element is accessible to an operator without removing the housing or any portion thereof.

Embodiment 8

The top drive of embodiment 7, wherein the at least one securing element is removable from the engagement interface without removing the housing or any portion thereof.

Embodiment 9

The top drive of embodiment 1, further comprising a bonnet coupled to the housing, wherein at least a portion of the bonnet is disposed above the upper surface of the bearing.

Embodiment 10

The top drive of embodiment 9, wherein the bonnet comprises an opening adapted to permit passage of the quill into and from the housing while the bonnet remains attached to the housing.

Embodiment 11

The top drive of embodiment 9, wherein the bonnet comprises a body defining cutouts adapted to permit operator access to the engagement interface.

Embodiment 12

The top drive of embodiment 11, wherein the body defines a generally frustoconical shape, and wherein the cutouts are disposed on side surfaces of the frustoconical shape.

Embodiment 13

The top drive of embodiment 1, wherein the quill comprises an elongated member and a flange extending radially from the elongated member at a longitudinal end thereof.

Embodiment 14

The top drive of embodiment 13, wherein the flange is adapted to engage with the spindle at the engagement interface.

Embodiment 15

The top drive of embodiment 13, wherein the flange is disposed at an upper end of the elongated member as oriented during drilling operations.

Embodiment 16

The top drive of embodiment 15, wherein the quill further comprises a torque transfer element disposed below the flange during drilling operations.

Embodiment 17

The top drive of embodiment 16, wherein the torque transfer element comprises a key, a gear, tooth, spline, cutout, groove, or other complementary engagement feature adapted to engage with the bearing.

Embodiment 18

A top drive comprising:

a housing;

a spindle rotatably coupled with the housing;

a bonnet coupled with the housing; and a quill coupled with the spindle, wherein the quill is removable from the top drive through the bonnet without altering the housing or bonnet with respect the top drive.

Embodiment 19

The top drive of embodiment 18, wherein the bonnet defines an opening adapted to permit passage of the quill therethrough while the bonnet remains attached to the housing.

Embodiment 20

The top drive of embodiment 19, wherein the bonnet is coupled to an upper portion of the housing.

Embodiment 21

The top drive of embodiment 18, wherein the spindle is rotatably coupled to the housing through a bearing.

Embodiment 22

The top drive of embodiment 18, further comprising at least one securing element adapted to couple the quill and spindle together.

Embodiment 23

The top drive of embodiment 22, wherein the at least one securing element comprises a threaded fastener.

Embodiment 24

The top drive of embodiment 22, wherein the at least one securing element and quill are removable from top drive in a generally same direction.

Embodiment 25

The top drive of embodiment 22, wherein at least a portion of the at least one securing element is visible when the top drive is in operation.

Embodiment 26

The top drive of embodiment 22, wherein the at least one securing element is accessible to an operator without removing the housing or any portion thereof.

Embodiment 27

The top drive of embodiment 22, wherein the at least one securing element is removable without removing the housing or any portion thereof.

Embodiment 28

The top drive of embodiment 18, wherein the quill comprises an elongated member and a flange extending radially from the elongated member at a longitudinal end thereof.

Embodiment 29

The top drive of embodiment 28, wherein the flange is adapted to engage with the spindle at an engagement interface disposed above a bearing adapted to couple the spindle to the housing.

Embodiment 30

The top drive of embodiment 28, wherein the flange is disposed at an upper end of the elongated member as oriented during drilling operations.

Embodiment 31

The top drive of embodiment 30, wherein the quill further comprises a torque transfer element disposed below the flange during drilling operations.

Embodiment 32

The top drive of embodiment 31, wherein the torque transfer element comprises a key adapted to engage with a drive element of the top drive.

Embodiment 33

A method of installing a quill in a top drive comprising:

providing a top drive preassembly comprising a housing, a bonnet coupled with the housing, and a spindle coupled with the housing;

translating the quill in a direction toward the top drive preassembly through an opening in the bonnet; and after aligning the quill relative to the top drive preassembly, securing the quill to the top drive preassembly with a securing element.

Embodiment 34

The method of embodiment 33, wherein aligning the quill relative to the top drive preassembly comprises aligning the quill relative to the spindle.

Embodiment 35

The method of embodiment 34, wherein the spindle defines an upper surface and a lower surface as oriented during drilling operations, and wherein the quill is adapted to contact the spindle along the upper surface.

Embodiment 36

The method of embodiment 33, wherein the securing element comprises a threaded fastener.

Embodiment 37

The method of embodiment 36, wherein securing the quill to the top drive preassembly is performed by securing the quill to the spindle by the threaded fastener.

Embodiment 38

The method of embodiment 33, wherein the spindle defines an upper surface and a lower surface as oriented during drilling operations, and wherein translating the quill in a direction toward the top drive preassembly is performed until a flange of the quill contacts the upper surface of the spindle.

Embodiment 39

The method of embodiment 33, wherein the opening in the bonnet is disposed along an upper surface of the bonnet.

Embodiment 40

The method of embodiment 33, wherein securing the quill to the top drive preassembly comprises an operator reaching through one or more cutouts in the bonnet to an engagement interface between the quill and top drive preassembly.

Embodiment 41

The method of embodiment 33, further comprising engaging a drive element of the top drive to rotate the quill after securing the quill to the top drive.

Embodiment 42

The method of embodiment 33, further comprising coupling an upper seal ring, wash pipe, cap, gooseneck, or any combination thereof to the top drive.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The invention claimed is:

1. A top drive comprising:
- a housing;
- a bonnet connected to a top of the housing;
- a cap coupled to a top of the bonnet;
- a gooseneck coupled to the cap;
- a bearing coupled to the housing, the bearing defining an upper surface;
- a quill coupled to the bearing,
- wherein the quill comprises a flange with a lower surface,
- wherein an engagement interface comprises the lower surface of the flange and the upper surface of the bearing with the lower surface of the flange being disposed above the upper surface of the bearing, and
- wherein the gooseneck is configured to flow fluid through a flow passage in the gooseneck to a flow passage in the quill; and
- a spindle disposed between the upper surface of the bearing and the lower surface of the flange.

2. The top drive of claim 1, wherein the quill is coupled with the spindle by two or more securing elements, and wherein the two or more securing elements are accessible to an operator through an opening in the bonnet of the top drive.

3. The top drive of claim 1, wherein the quill is rotatably secured to the bearing by one of a key, a gear, a tooth, a spline, a cutout, a groove, or other complementary engagement feature adapted to engage with the bearing.

4. The top drive of claim 1, wherein the quill is coupled with the spindle by at least one securing element, and wherein the at least one securing element is accessible to an operator through an opening in the bonnet of the top drive.

5. The top drive of claim 4, wherein the at least one securing element is removable from the engagement interface through the opening in the bonnet of the top drive.

6. The top drive of claim 1, wherein at least a portion of the bonnet is disposed above the upper surface of the bearing.

7. The top drive of claim 6, wherein the bonnet comprises an opening adapted to permit passage of the quill into and from the housing while the bonnet remains attached to the housing.

8. The top drive of claim 6, wherein the bonnet comprises a body defining cutouts adapted to permit operator access to the engagement interface.

9. The top drive of claim 8, wherein the body defines a generally frustoconical shape, and wherein the cutouts are disposed on side surfaces of the frustoconical shape.

10. A top drive comprising:
- a housing with a central axis;
- a bonnet connected to a top of the housing, the bonnet comprising a cutout in a side surface of the bonnet;
- a cap coupled to a top of the bonnet;
- a gooseneck coupled to the cap;
- a spindle rotatably coupled with the housing;
- a quill coupled with the spindle, wherein the quill is removable from the top drive through the bonnet while the bonnet remains coupled to the housing with the cap removed from the bonnet and wherein the quill is rotatable about the central axis; and
- at least one securing element adapted to couple the quill and the spindle together, wherein the at least one securing element is disposed in an orientation that is parallel to the central axis, and wherein the at least one securing element is accessible through the cutout in the side surface of the bonnet.

11. The top drive of claim 10, wherein the bonnet defines an opening adapted to permit passage of the quill therethrough while the bonnet remains coupled to the housing.

12. The top drive of claim 10, wherein the at least one securing element comprises two or more securing elements.

13. The top drive of claim 10, wherein at least a portion of the at least one securing element is visible when the top drive is in operation.

14. The top drive of claim 10, wherein the at least one securing element is accessible to an operator while the bonnet remains coupled to the housing.

15. The top drive of claim 10, wherein the at least one securing element is removable while the bonnet remains coupled to the housing.

16. The top drive of claim 10, wherein the quill comprises an elongated member and a flange extending radially from the elongated member at a longitudinal end thereof, and wherein the flange is adapted to engage with the spindle at an engagement interface disposed above a bearing adapted to couple the spindle to the housing.

17. A method of installing a quill in a top drive comprising:

providing a top drive preassembly comprising a housing, a bonnet connected to a top of the housing, and a spindle coupled with the housing;

translating the quill in a direction toward the top drive preassembly through an opening in the bonnet; and after aligning the quill relative to the top drive preassembly, securing the quill to the top drive preassembly with a securing element, wherein securing the quill to the top drive preassembly comprises an operator reaching through one or more cutouts in the bonnet to an engagement interface between the quill and top drive preassembly.

18. The method of claim 17, wherein aligning the quill relative to the top drive preassembly comprises aligning the quill relative to the spindle.

19. The method of claim 17, wherein the spindle defines an upper surface and a lower surface as oriented during drilling operations, and wherein translating the quill in a direction toward the top drive preassembly is performed until a flange of the quill contacts the upper surface of the spindle.

20. The method of claim 17, wherein securing the quill to the top drive preassembly comprises an operator reaching through one or more cutouts in the bonnet to access a securing element disposed between the quill and top drive preassembly.

* * * * *